US006494700B1

(12) United States Patent
Stammen

(10) Patent No.: US 6,494,700 B1
(45) Date of Patent: Dec. 17, 2002

(54) MELT SPINNING LINE FOR PRODUCING MULTIFILAMENT YARNS

(75) Inventor: Markus Stammen, Bergisch Gladbach (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/600,939

(22) PCT Filed: Jan. 21, 1999

(86) PCT No.: PCT/EP99/00389

§ 371 (c)(1),
(2), (4) Date: Aug. 3, 2000

(87) PCT Pub. No.: WO99/37835

PCT Pub. Date: Jul. 29, 1999

(30) Foreign Application Priority Data

Jan. 24, 1998 (DE) ..... 198 02 683

(51) Int. Cl.[7] ..... D01D 4/02; D01D 7/00

(52) U.S. Cl. ..... 425/135; 425/308; 425/377; 425/382.2; 425/464

(58) Field of Search ..... 425/72.2, 136, 425/377, 308, 382.2, 135, 464

(56) References Cited

U.S. PATENT DOCUMENTS 4,666,590 A * 5/1987 Sano et al. ..... 209/2
5,324,358 A 6/1994 Tseng ..... 118/670
5,928,579 A * 7/1999 Spahlinger et al. ..... 425/377

FOREIGN PATENT DOCUMENTS

DE 274059 A1 12/1989
JP 56009416 1/1981
JP 62156307 7/1987

* cited by examiner

*Primary Examiner*—Jan H. Silbaugh
*Assistant Examiner*—Joseph Leyson
(74) *Attorney, Agent, or Firm*—Alston & Bird LLP

(57) ABSTRACT

The invention relates to a spinning line for producing a plurality of endless synthetic filament yarns. The spinning line comprises a spinning apparatus for melt spinning the yarns and a takeup apparatus for winding the yarns. Between the spinning apparatus and the takeup apparatus, a yarn collection device is arranged which cuts and removes the yarns by suction upon occurrence of a disturbance in the yarn path of at least one yarn. To this end, the yarn collection device comprises a movable yarn guide with a yarn guide groove in the yarn advance plane, a cutting device, and a suction device. The cutting device and suction device are arranged in the yarn advance plane on one side of the yarn web. The yarn guide is arranged on the opposite side of the yarn web and moved in direction of the cutting device for cutting the yarns.

16 Claims, 2 Drawing Sheets

MELT SPINNING LINE FOR PRODUCING MULTIFILAMENT YARNS

BACKGROUND OF THE INVENTION

A spinning line for producing a plurality of endless synthetic filament yarns.

To produce endless synthetic filament yarns spinning lines are used, wherein in a spinning apparatus the yarns are first spun from a molten plastic. To this end, a melt is supplied at a spinning position to a spinneret. The spinneret has a plurality of bores through which the molten plastic is extruded. The filaments individually emerging from the spinneret advance through a cooling zone and are combined to a yarn at the end of the cooling zone. In the spinning apparatus of a spinning line, a plurality of spinning positions are arranged side by side, so that six, eight, or maximally ten yarns are spun at the same time.

After the yarns have advanced through a treatment zone downstream of the spinning apparatus, they are wound to packages in a takeup apparatus. In the treatment zone, an individual treatment that depends on the polymer type and yarn type, is performed on the yarn by lubricating, drawing, heating, relaxing, entangling, or a combination of these treatment methods.

In such complex lines, disturbances are never totally preventable in the yarn path. Such disturbances may be caused, for example, by yarn breaks or formation of laps, for example in a godet system. To eliminate disturbance, as well as to avoid rejects, it is necessary that the web of yarns of the spinning line be cut and taken into a suction device. To this end, so-called yarn collection devices are provided in the spinning line.

U.S. Pat. No. 5,324,358 discloses such a yarn collection device, wherein each individual yarn advances through a cutting device and a suction device. In the case of a disturbance, the cutting device is activated. The yarn ends are taken over by the suction device. This ensures that the spinning apparatus of the spinning line continues its operation uninterrupted. The known yarn collection device has the disadvantage that each individual yarn is taken into a separate suction device. Since an operator guides the web of yarns in a manual suction device when threading the yarns in a spinning line, it will be necessary that the operator first remove each individual yarn from the suction device. In addition, the known yarn collection device requires a considerable expenditure for apparatus with a correspondingly high susceptibility to disturbances.

It is therefore the object of the invention to further develop a spinning line of the initially described kind such that it facilitates both a fast collection of the yarns and a correspondingly fast threadup of the yarns in the spinning line.

SUMMARY OF THE INVENTION

In accordance with the invention, this object is accomplished in that the yarn collection device comprises a movable yarn guide with a yarn guide groove in the plane of the yarn advance, a cutting device, and a suction device, the cutting device and suction device being arranged on one side of the web of yarns. Before cutting the yarns, the yarn guide is located on the opposite side of the group of yarns, and for cutting the yarns, it can be moved in direction of the cutting device. The advantage of the invention lies in that it is possible to combine the web of yarns to a bundle regardless of the number of yarns, and to supply same to a suction device. This bundling of the yarn web permits direct rethreading, for example, in the takeup apparatus without any substantial delay, after eliminating the disturbance. To this end, it would be possible to use, for example, a suction device that is constructed as a hand gun. To bundle and cut the group of yarns, only one movable yarn guide used, which results in a particularly simple construction of the yarn collection device.

To facilitate the cutting of the yarns in a tensioned state, the yarn guide has two yarn guide grooves adjoining each other in one plane, in which the individual yarns are collected. By deflecting the yarns, it is possible to tension partial lengths of the yarns that extend between the two yarn guide grooves. With that, it is easy to cut the yarn.

The cutting device preferably is formed by a cutter whose blade extends between the legs of the yarn guide during the cutting of the yarns. This ensures a reliable cutting of the yarns without movable structural parts. To facilitate collection of the yarns during the movement of the yarn guide parallel to the plane of the yarn advance, the yarn guide groove is made V-shaped, so that yarns slide with certainty into the yarn guide groove.

According to a further, particularly advantageous embodiment, the yarn guide is connected to a carriage that is movable by means of a drive along a straight guideway parallel to the plane of the yarn advance. This permits an unimpeded yarn advance in the spinning line when the yarn collection device is not activated. The carriage is arranged for movement along the straight guideway on the side of the yarn web.

In a particularly advantageous embodiment of the spinning line, the drive of the yarn guide is realized by a pneumatically movable magnetic piston inside a tube. This magnetic piston is coupled by magnetic forces with a countermagnet of the carriage. The countermagnet is arranged for movement with the carriage on the circumference of the tube. By the movement of the magnetic piston in the interior of the tube, it is possible to displace the yarn guide without additional displacement mechanisms. In this instance, it is preferred to move the magnetic piston in the interior of the tube pneumatically.

In a further, especially preferred embodiment of the spinning line, the drive is connected to a control unit which receives signals from a sensor arrangement that monitors the yarn paths. Upon occurrence of a disturbance, it is thus possible to bundle the yarns without substantial time delay.

According to a further advantageous embodiment of the spinning line, the sensor arrangement comprises a yarn break sensor for each yarn.

BRIEF DESCRIPTION OF THE DRAWINGS

An embodiment is described below in more detail with reference to the attached drawings, in which.

DETAILED DESCRIPTION OF THE PREFERRED EMBODIMENT

Figure 1:
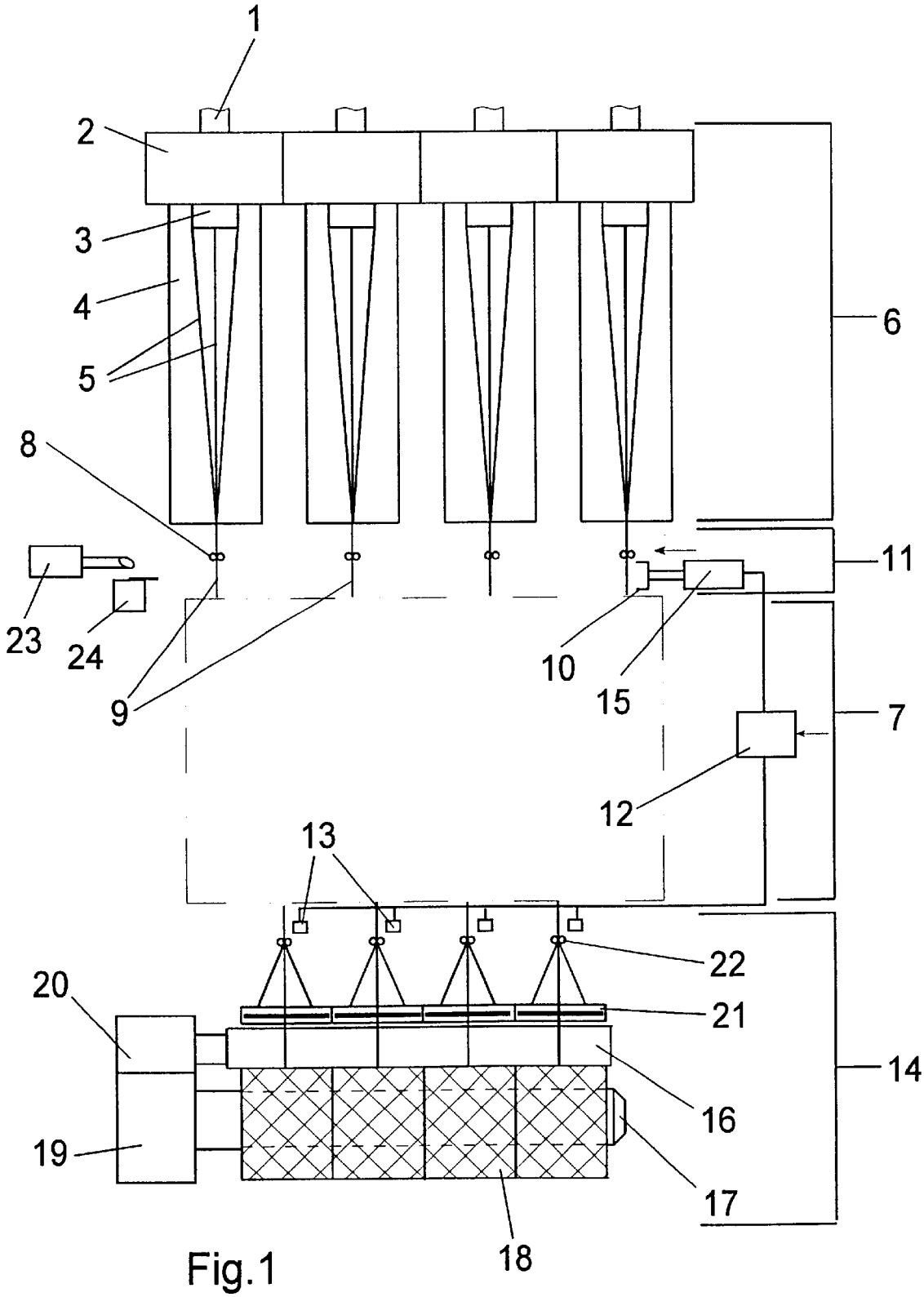
FIG. 1 is a schematic view of a spinning line for producing a plurality of endless synthetic filament yarns.

FIG. 1 is a schematic view of a spinning line for producing a plurality of endless synthetic filament yarns. The spinning line comprises a spinning apparatus 6 for melt spinning yarns 9, as well as a takeup apparatus 14 for winding the yarns 9 to packages 18. The spinning apparatus 6 comprises a spin head 2 which is supplied via a melt supply line 1 with a molten polymer by means of an extruder or a pump. Inside spin head 2, the melt flow is guided to a spinneret 3 arranged below the spin head 2, and it is spun through numerous nozzle bores in the spinneret 3 to a plurality of filaments 5. By way of example, the spinning line comprises a total of four spinning positions. The four spinning positions are arranged side by side. Since each yarn 9 of a spinning position is treated in like manner, the spinning line is described in the following with reference to one yarn path.

After the filament bundle 5 has emerged from the spinneret 3, it advances to a cooling shaft 4 downstream of the spinneret. In so doing, the filament bundle 5 is cooled preferably by an air current. After cooling, the filament bundle 5 is combined in a yarn guide 8 to a yarn 9, and leaves the spinning apparatus 6.

Downstream of the spinning apparatus is a takeup apparatus 14. At the yarn inlet end, the takeup apparatus 14 is provided with a stationary yarn guide 22. The stationary yarn guide 22 is associated to one of a total of four winding positions of the takeup apparatus 14. In each winding position, the yarn advances through a traversing device 21 that reciprocates the yarn 9 along a traverse stroke substantially transversely to the direction of its advance. The traversing device 21 may be of the rotary blade type, or it may be realized by a cross-spiralled roll. Between the traversing device 21 and the yarn guide 22, a so-called traversing triangle forms. Downstream of the traversing device, the yarn advances onto a contact roll 16 that is mounted for rotation in a machine frame 20. The yarn partially loops bout contact roll 16. Thereafter, it is deposited on a package 18. The package 18 is inserted on a winding spindle 17 that is driven by means of a spindle motor 19. The spindle motor 19 is controlled as a function of the circumferential speed of contact roll 16 in such a manner that the circumferential speed of package 18 is always constant, so that the yarn is wound at a constant takeup speed.

Between the spinning apparatus 6 and the takeup device 14, the yarns 9 advance in one plane through a yarn collection device 11. The yarn collection device 11 consists of suction device 23 arranged in the yarn advance plane laterally adjacent the yarns 9 and a cutting device 24. On the opposite side of the yarn web, a yarn guide 10 extends in the plane of the advancing yarns. The yarn guide 10 connects to a drive 15. The drive 15 causes the yarn guide 10 with a guide groove for receiving the yarns to move within the yarn advance plane in direction of the cutting device 24. The drive 15 connects to a controller 12. The controller 12 itself connects to a sensor arrangement with a plurality of yarn break sensors 13, each for one yarn 9. In this arrangement, the drive 15 is controlled by controller 12. When one of the yarn break sensors 13 signals a yarn break to the controller 12, the drive 15 will be activated. The yarn guide 10 is moved from its idle position laterally adjacent the yarn web to a collection position laterally adjacent the yarn web on the opposite side. In the collecting position, the yarns 9 are guided as a bundle to the cutting device 24 and cut by same. After the yarns 9 are cut, the suction device 23 will engage and take in the yarns. Now, it is possible to eliminate a yarn break that has been caused, for example, by a lap formation on the contact roll. While removing the disturbance, the yarn guide 10 is returned to its idle position. After eliminating the disturbance, an operator manually threads yarns 9 on the takeup apparatus 14.

In the spinning line shown in FIG. 1, the yarn collection device 11 is arranged directly downstream of the spinning apparatus 6. This is of advantage, since the yarns 9 can advance through a treatment zone 7 between the takeup apparatus 14 and the spinning apparatus 6. However, it is also possible to arrange the yarn collection device 11 directly upstream of the takeup apparatus 14 or within the treatment zone 7. In the treatment zone 7, the yarns 9 are treated before being wound as a function of the yarn type being produced as well as a function of the polymer type. In this connection, the yarns 9 are at least lubricated, so that the filaments remain bundled in the yarn. In addition, they may undergo a drawing and/or relaxation with or without heat treatment. To increase the yarn coherence, it is also common to subject the individual filaments of each yarn to an entanglement in the treatment zone.

Figure 2:
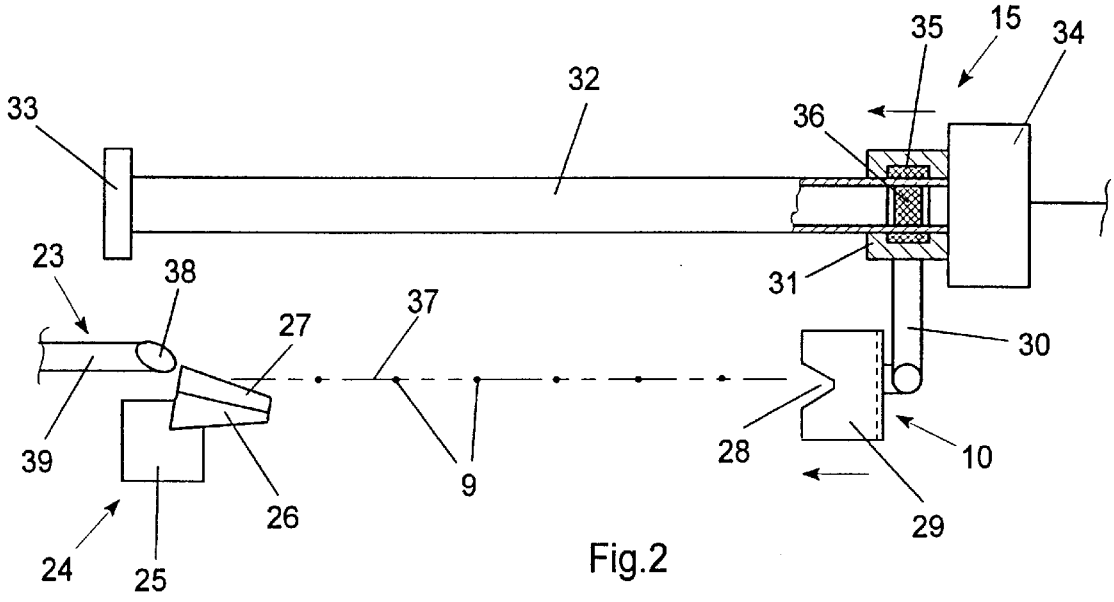
FIGS. 2 and 3 are each a schematic view of a yarn collection device as can be used in the spinning line of FIG. 1.
Figure 3:
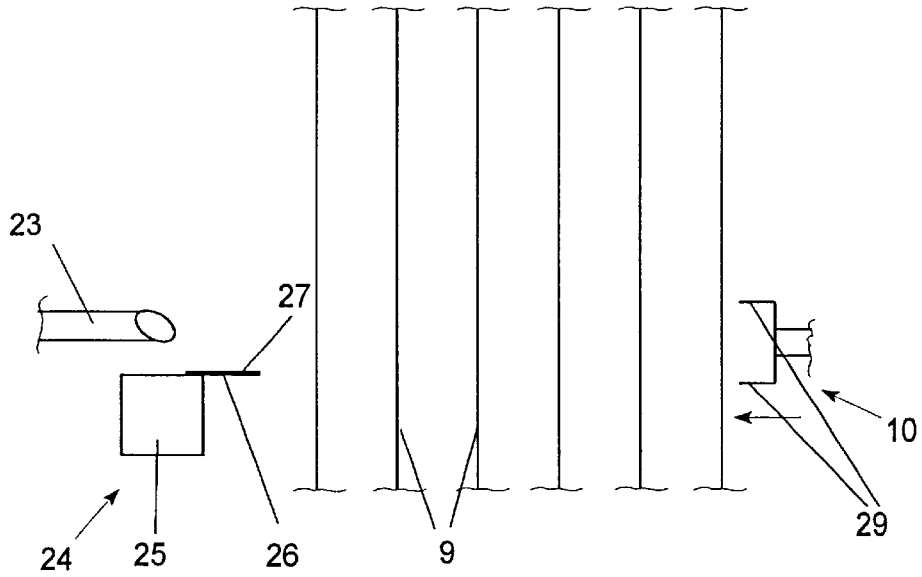

FIGS. 2 and 3 illustrate a further embodiment of a yarn collection device as can be used in a spinning line of FIG. 1. Unless otherwise specified, the following description applies to FIGS. 2 and 3.

The yarn collection device, as illustrated, consists of the suction device 23 and the cutting device 24 that is arranged on one side of the yarns 9 in a yarn advance plane 37. On the opposite side of the yarns 9, the yarn guide 10 is arranged in the yarn advance plane 37. The yarn guide 10 is U-shaped and has in each free end of legs 29 one yarn guide groove 28. The yarn guide grooves 28 are arranged in the legs 29 in V-shape crosswise to the yarn advance plane, and they extend in the yarn advance plane 37. The yarn guide 10 is connected via a holder 30 to a carriage 31. The carriage 31 is arranged for movement along the circumference of a tube 32. Inside the tube 32, a magnetic piston 36 is arranged for displacement therein. The carriage 31 is provided with an annular countermagnet 35 that extends for movement on the circumference of the tube 31 and faces the magnetic piston 36. The magnetic piston 36 and countermagnet 35 face each other with opposite polarity, so that there is a magnetic connection. At the one end of tube 32, a control device 34 is arranged through which compressed air is supplied to or discharged from the interior of tube 32. The tube 32 extends parallel to the yarn advance plane over the entire width of the yarn web. On the opposite side of the tube, a cover 33 is arranged at the end thereof. The cover 33 extends beyond the circumference of the tube 32 and serves as a stop for carriage 31.

The suction device 23 has an opening 38 of a suction intake tube 39. The suction intake tube 39 connects to a suction system, so that the yarns 9 can be pulled into the suction opening. The suction device 23 is arranged in the region of cutting device 24 such that the yarns are sucked into the opening 38 directly after they cut.

The cutting device 24 comprises a cutter 26 with a blade 27 extending into the path of motion of yarn guide 10. The cutter 26 is mounted on a support 25.

In an event of disturbance, a control device not shown activates the control device 34, so that compressed air enters into the interior of the tube 32. The magnetic piston 36 moves out of its idle position. At the same time, the yarn guide 10 is thereby moved in the direction of cutting device 24. In so doing, the yarns 9 are collected in the yarn guide groove 28 and guided as a yarn bundle to the cutting device 24 on the opposite side. The cutter 26 of the cutting device 24 engages between the legs 29 of the yarn guide and cuts the yarns 9. Subsequently, the yarns are taken into the suction device 23 and removed by suction. As soon as the yarns 9 are caught as a bundle by the suction device 23, the controller 34 is reversed, so that compressed air enters into the interior of the tube from the cover side. The magnetic piston returns to its idle position, thereby returning the carriage 31 with the yarn guide 10 likewise to their initial position.

What is claimed is:

1. A yarn spinning line for producing a plurality of endless synthetic filament yarns, comprising a spinning apparatus for melt spinning a plurality of advancing yarns which define a plane, a takeup apparatus for winding each of the advancing yarns into a package, a yarn collection device arranged between the spinning apparatus and the takeup apparatus which acts to cut and remove the yarns by suction during a disturbance in the yarn path of at least one yarn, and comprising (a) a yarn guide mounted for movement from an idle position which is aligned with the yarn plane adjacent one side thereof, along the yarn plane, and to an operative position adjacent the other side of the yarn plane, (b) a fixedly mounted cutting device and a suction device both positioned in general alignment with the yarn plane adjacent said other side of the yarn plane, and (c) a drive for moving the yarn guide from its idle position to its operative position such that the yarns are collected and brought into contact with the cutting device and conveyed away by the suction device, and for also moving the yarn guide from its operative position back to its idle position, and wherein the yarn guide is connected to a carriage that is moveable by said drive along a straight guideway which is parallel to the yarn plane.

2. The yarn spinning line as defined in claim 1 wherein the yarn guide has a U-shaped configuration which includes a pair of parallel legs which are perpendicular to the yarn plane and spaced apart in the direction of the yarn advance, with each leg including a groove located in the yarn plane for receiving the yarns during movement of the yarn guide from its idle position towards its operative position.

3. The yarn spinning line as defined in claim 2 wherein the cutting device is positioned so as to be received between the legs of the yarn guide when the yarn guide reaches its operative position, and so that the yarns are cut at a location between the legs.

4. The yarn spinning line as defined in claim 3 wherein the cutting device comprises a blade.

5. The yarn spinning line as defined in claim 2 wherein the groove in each of the legs of the yarn guide has a V-shaped cross section.

6. The yarn spinning line as defined in claim 1 wherein the drive comprises a pneumatically displaceable magnetic piston inside a tube, and the carriage includes a countermagnet that is arranged for movement along the outside circumference of the tube and which has a polarity opposite that of the magnetic piston.

7. The yarn spinning line as defined in claim 1 wherein the drive further comprises a controller that is connected to at least one sensor for monitoring the yarn paths.

8. The yarn spinning line as defined in claim 7 wherein the at least one sensor comprises a yarn break sensor for each yarn.

9. A yarn spinning line for producing a plurality of endless synthetic filament yarns, comprising a spinning apparatus for melt spinning a plurality of advancing yarns which define a plane, a takeup apparatus for winding each of the advancing yarns into a package, a yarn collection device arranged between the spinning apparatus and the takeup apparatus which acts to cut and remove the yarns by suction during a disturbance in the yarn path of at least one yarn, and comprising (a) a yarn guide mounted for movement from an idle position which is aligned with the yarn plane adjacent one side thereof, along the yarn plane, and to an operative position adjacent the other side of the yarn plane, (b) a fixedly mounted cutting device and a suction device both positioned in general alignment with the yarn plane adjacent said other side of the yarn plane, and (c) a drive for moving the yarn guide from its idle position to its operative position such that the yarns are collected and brought into contact with the cutting device and conveyed away by the suction device, and for also moving the yarn guide from its operative position back to its idle position, and wherein the cutting device comprises a blade which is mounted to a support which is located adjacent said other side of the yarn plane.

10. The yarn spinning line as defined in claim 9 wherein the yarn guide has a U-shaped configuration which includes a pair of parallel legs which are perpendicular to the yarn plane and spaced apart in the direction of the yarn advance, with each leg including a groove located in the yarn plane for receiving the yarns during movement of the yarn guide from its idle position towards its operative position.

11. The yarn spinning line as defined in claim 10 wherein the cutting device is positioned so as to be received between the legs of the yarn guide when the yarn guide reaches its operative position, and so that the yarns are cut at a location between the legs.

12. The yarn spinning line as defined in claim 11 wherein the groove in each of the legs of the yarn guide has a V-shaped cross section.

13. The yarn spinning line as defined in claim 9 wherein the yarn guide is connected to a carriage that is moveable by said drive along a straight guideway which is parallel to the yarn plane.

14. The yarn spinning line as defined in claim 13 wherein the drive comprises a pneumatically displaceable magnetic piston inside a tube, and the carriage includes a countermagnet that is arranged for movement along the outside circumference of the tube and which has a polarity opposite that of the magnetic piston.

15. The yarn spinning line as defined in claim 13 wherein the drive further comprises a controller that is connected to at least one sensor for monitoring the yarn paths.

16. The yarn spinning line as defined in claim 15 wherein the at least one sensor comprises a yarn break sensor for each yarn.

* * * * *